US007029178B2

(12) United States Patent
Gzybowski

(10) Patent No.: US 7,029,178 B2
(45) Date of Patent: Apr. 18, 2006

(54) ZIP-LOCK CLOSURE

(75) Inventor: Michael S. Gzybowski, Ann Arbor, MI (US)

(73) Assignee: GHT Ventures, LLC, Ann Arbor, MI (US)

( * ) Notice: Subject to any disclaimer, the term of this patent is extended or adjusted under 35 U.S.C. 154(b) by 0 days.

(21) Appl. No.: 10/264,755

(22) Filed: Oct. 4, 2002

(65) Prior Publication Data

US 2004/0064923 A1 Apr. 8, 2004

(51) Int. Cl.
*B65D 33/16* (2006.01)

(52) U.S. Cl. ..... 383/64; 24/399

(58) Field of Classification Search ..... 383/5, 383/209, 64; 24/399, 400
See application file for complete search history.

(56) References Cited

U.S. PATENT DOCUMENTS

| | | | | |
|---|---|---|---|---|
| 2,810,944 | A | 10/1957 | Sander | |
| 4,183,119 | A | 1/1980 | Stewart et al. | |
| 4,197,611 | A | 4/1980 | Bell et al. | |
| 4,744,674 | A | 5/1988 | Nocek | |
| 4,792,983 | A | 12/1988 | Allegre | |
| 4,892,414 | A | 1/1990 | Ausnit | |
| 4,923,309 | A | 5/1990 | VanErden | |
| 4,964,739 | A | 10/1990 | Branson et al. | |
| 5,189,764 | A * | 3/1993 | Herrington et al. | 24/384 |
| 5,372,428 | A | 12/1994 | Bruno et al. | |
| D366,728 | S | 1/1996 | Ryu | |
| 5,669,715 | A * | 9/1997 | Dobreski et al. | 383/5 |
| 5,722,128 | A * | 3/1998 | Toney et al. | 24/400 |
| 5,809,621 | A | 9/1998 | McCree et al. | |
| 5,867,867 | A | 2/1999 | Kessler | |
| D408,703 | S | 4/1999 | Hreha et al. | |
| 5,927,855 | A | 7/1999 | Tomic et al. | |
| 5,953,796 | A | 9/1999 | McMahon et al. | |
| 5,956,815 | A | 9/1999 | O'Connor et al. | |
| 6,004,032 | A | 12/1999 | Kapperman et al. | |
| 6,014,795 | A | 1/2000 | McMahon et al. | |
| D426,450 | S | 6/2000 | Eklind | |
| D430,477 | S | 9/2000 | Mowery | |
| 6,135,636 | A | 10/2000 | Randall | |
| 6,220,754 | B1 | 4/2001 | Stiglic et al. | |
| D445,301 | S | 7/2001 | Levie | |
| 6,286,999 | B1 * | 9/2001 | Cappel et al. | 383/5 |
| D453,292 | S | 2/2002 | Tsuzuki | |
| 6,487,759 | B1 * | 12/2002 | Akeno et al. | 24/589.1 |
| 6,592,260 | B1 * | 7/2003 | Randall et al. | 383/64 |
| 6,626,600 | B1 | 9/2003 | Brand et al. | |
| 6,899,460 | B1 * | 5/2005 | Turvey et al. | 383/33 |

* cited by examiner

*Primary Examiner*—Jes F. Pascua

(57) ABSTRACT

A one-way, zip-locking closure for bag-type containers that include slider zipper arrangements. The locking mechanism includes a series of registration structures that is provided along one side of the mouth of the containers and a catch mechanism that is provided within the slider. The catch mechanism engages the series of registration structures as the slider is moved to close the mouth of the container, and thereby prevents movement of the slider in the opposite direction.

8 Claims, 3 Drawing Sheets

ZIP-LOCK CLOSURE

TECHNICAL FIELD

The present invention relates to closure arrangements for flexible bag-type containers. More particularly, the present invention relates to one-way zip-locking closures for bag-type containers.

BACKGROUND ART

There are numerous closures for bag-type containers such as polymeric bags that are used for storing non-food items, food products, medical supplies, waste materials, and many other items.

Bag-type containers having closure structures are well known. Typically bag-type containers are provided with mouths or openings along a top side thereof. The mouths or openings are defined by opposed side edges of the containers that can be coupled together along the top side (the closed position) or uncoupled so as to define the mouth or opening (the open position). To provide such a closable function, the opposite side edges of the containers are provided with cooperating structural features that can be coupled together or interlocked.

There are different types of closure structures for bag-type containers, including those that include slider devices that couple and uncouple the closure structures, those that are do not include slider devices that couple and uncouple the closure structures, and those that are resealable and those that are not resealable.

U.S. Pat. No. 5,138,750 to Gundlach et al. exemplifies a bag-type closure that includes a closure structure that is operated by pressing the opposite sides of the mouth of the bag together. Using this type of bag-type closure, the user typically squeezes the opposite sides of the mouth together between his or her thumb and index finger and slides his or her finger and thumb along the mouth of the bag so that the cooperating interlocking or coupling structures are engaged together. An alternative approach that some people take is to squeeze incremental portions of the opposite sides of the mouth of the bag together along the length there. Once closed, the mouth of the bag can be opened by gripping and pulling the opposite sides of the mouth of the bag apart. Such a bag is resealable.

U.S. Pat. No. 2,810,944 to Sander exemplifies a bag-type closure that includes a closure mechanism having a slider. The slider can be thought of as providing a function similar the user's thumb and index finger as discussed above in U.S. Pat. No. 5,138,750. That is, the slider, which is slidably coupled to each of the opposite sides of the mouth of the bag, is configured so that as it is slid in one direction, it couples the cooperating interlocking or coupling structures of the mouth of the bag together. In contrast, as the slider is slid in the opposite direction, it uncouples the cooperating interlocking or coupling structures of the mouth of the bag.

U.S. Pat. No. 5,372,428 to Bruno et al. and U.S. Pat. No. 6,004,032 to Kapperman et al. exemplify non-resealable bag-type closures which are configured to be permanently sealed after various items and substances are placed therein. The mouths of non-resealable bag-type closures include cooperating interlocking or coupling structures, which when engaged together, resist being opened. In some cases, it is known to provide bags having non-resealable bag-type closures with secondary means for gaining access to the contents thereof. For example such bags can include tearable, e.g. perforated, frangible, etc. portions that can be torn apart to gain access to the contents of the bags.

The present invention provides one-way zip-locking closures for bag-type containers.

DISCLOSURE OF THE INVENTION

According to various features, characteristics and embodiments of the present invention which will become apparent as the description thereof proceeds, the present invention provides a one-way, zip-locking closure for a bag-type container having a mouth defined by opposed side panels, the one-way, zip-locking closure including:

cooperating coupling structures on inner surfaces of the opposed side panels adjacent the mouth;

a slider coupled to the cooperating coupling structures for closing the mouth of the bag-type container when slid in a first direction between a first position to a second position;

a series of registration structures provided along at least one side of the mouth;

a catch mechanism provided within the slider for engaging the series of registration structures and thereby preventing the slider from sliding in a second direction opposite the first direction.

The present invention further provides an improvement in bag-type containers that include zip-lock mechanisms, including sliders, the improvement including:

a series of registration structures provided along at least a portion of a width of the container; and a catch mechanism within the slider which engages the series of registrations and thereby restricts movement of the slider in only one direction.

The present invention further provides a method of locking a mouth of a bag-type container in a closed position which comprises:

providing a bag-type container having a mouth defined by opposed side panels;

providing cooperating coupling structures on inner surfaces of the opposed side panels adjacent the mouth;

coupling a slider to the cooperating coupling structures for closing the mouth of the bag-type container when slid in a first direction between a first position to a second position;

providing a series of registration structures along at least one side of the mouth;

providing a catch mechanism within the slider for engaging the series of registration structures and thereby preventing the slider from sliding in a second direction opposite the first direction and sliding the slider along the first direction from an open position to a closed position so that the catch mechanism engages the series of registration structures and prevents movement of the slider in the second direction.

BRIEF DESCRIPTION OF DRAWINGS

The present invention will be described with reference to the attached drawings which are given as non-limiting examples only, in which.

BEST MODE FOR CARRYING OUT THE INVENTION

Figure 1:
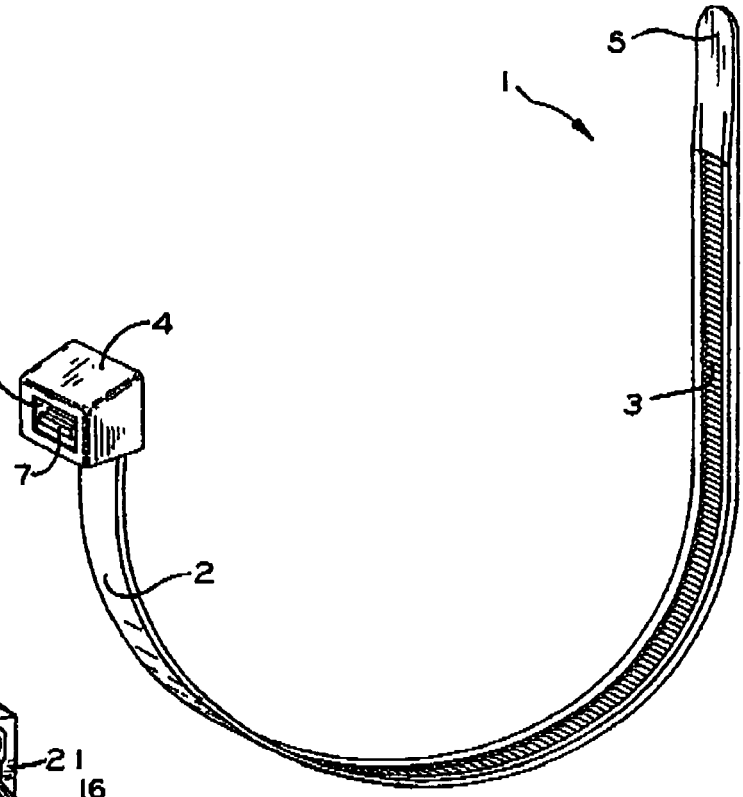
FIG. 1 is a perspective view of a conventional wire harness.

The present invention is directed to one-way zip-locking closures for bag-type containers. The one-way zip-locking closures of the present invention can be used in conjunction with a variety of containers that include mouths defined by opposed panel members. The one-way zip-locking closures of the present invention include a series of registration structures and a catch mechanism that is configured to engage the registration structures. The catch mechanism is provided on a slider structure and can comprise a biased structure that deflects against the registration structures in one direction and engages the registration structures in an opposite direction. The slider structure is configured to slide along the mouths of the containers. Opposite sides of the mouths of the containers are provided with cooperating interlocking or coupling structures which become engaged together as the slider is moved in one direction along the mouths. As the catch mechanism of the slider engages the registration structures, the slider is prevented from being slide in an opposite direction. Thus, in effect, a container provided with the one-way zip-locking mechanism of the present invention can be closed, but not opened once closed.

The one-way zip-lock mechanism of the present invention can be readily incorporated into the structure of conventional zip-lock plastic bags that include cooperating interlocking or coupling structures on opposite inner sides of the mouths thereof. For such incorporation, one or both of the outer sides of the mouth of the bags can be provided with the series of registration structures and an inner portion(s) of the slider can be provided with the catch mechanism(s).

According to one embodiment of the present invention, one or both of the outer surfaces of a zip-lock bag is/are provided with a series of teeth and the slider is provided with one or more tangs that is/are biased to engage the series of teeth in one direction. In alternative embodiments, the series of registration structures can be projections and/or depressions with any convenient shape, including rectangular, circular, etc., and the catch mechanism can be complementarily configured to engage the registration structures in one direction. It is also possible to provide the series of registration structures on less the entire width of the containers. For example, a discrete series of registration structures could be provided near the side of the container whereat the slider would be position when the mouth of the container is completely closed.

Since the one-way zipper-lock closures of the present invention are designed and configured to lock in the closed position, bag-type containers provided with the one-way zipper-lock closures can be cut open to gain access to the contents thereof. Otherwise, the bag-type containers of the present invention can be provided with rupturable, frangible, tearable, breachable, or similar structures or portions by which access to the contents thereof can be gained without the need of scissors, knifes, or other auxiliary tools. For example, a portion or area of the bag-type containers can be perforated or otherwise weakened or provided with non-resealable structures to gain access to the contents therein if desired.

FIG. 1 is a perspective view of a conventional wire harness. The wire harness 1 includes a strap 2 having a serrated portion 3 along one side thereof, a head 4 at one end of the strap 2 and a free end 5 opposite the head 4. The head 4 includes an aperture 6 that is configured to receive the strap 2 therein. The head 4 also includes an internal tang 7 which is configured to engage the strap 2 along the serrated portion 3 in a known manner. The wire harness 1 is used by inserting the free end 5 into the aperture 6 of the head 4 and pulling (or pushing) the strap 2 into and through the aperture 6 until the internal tang 7 engages the serrated portion 3 of the strap 2. The wire harness 1 is tightened about an article or articles by pulling the strap 2 tightly through the aperture 6. The tang 7 engages the serrated portion 3 of the strap 2 so that while the strap 2 can be pulled through the aperture 6 in the head 4 in one direction (the tightening direction), the strap 2 resists movement through the aperture 6 in an opposite direction. Wire harnesses are typically used to bundle wire together and therefore sometimes referred to as wire ties or wire straps. Once tightened, wire harnesses can only be opened by cutting the exposed strap portion or otherwise breaking the head or tang of thereof. The tangs of wire harnesses are typically biased to engage the serrated portions and deflect, when the strap is slid through the aperture in the head in the tightening or locking direction. When an attempt is made to slide the strap in the opposite direction, the biased tang engages the serrated portion and locks the strap from movement.

Figure 2:
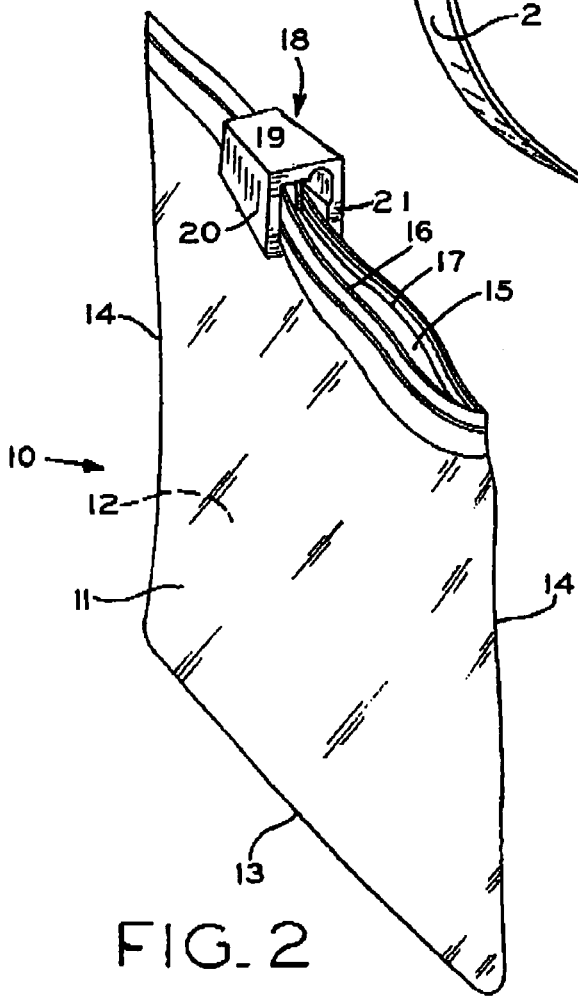
FIG. 2 is a perspective view that exemplifies a conventional a bag-type container, provided with a closure mechanism having a slider.

FIG. 2 is a perspective view that exemplifies a conventional a bag-type container, provided with a closure mechanism having a slider. The bag-type container 10 in FIG. 2 is formed from side panel members 11, 12 that are sealed together or integral along the bottom 13 and sides 14. A mouth or opening 15 provided along a top side of the bag-type container 10 is defined by opposed top side edges of the side panel members 11, 12. The opposite top side edges of the bag-type container 10 are provided with cooperating coupling structures 16, 17 that can be coupled together or interlocked. Such cooperating coupling structures 16, 17 are exemplified by elongate beading elements that have cross sectional profiles or shapes that allow the opposed beading elements on opposite sides of the mouth or opening 15 to engage and be coupled together or interlock. In the case of bag-type containers that are provided with a slider 18 as in the case of FIG. 2, the cooperating coupling structures 16, 17 (opposed beading elements) are configured so that when the slider 18 is slid in one direction, the slider 18 couples the cooperating coupling structures 16, 17 of the mouth or opening 15 of the bag-type container 10 together. In contrast, as the slider 18 is slid in the opposite direction, the slider 18 uncouples the cooperating coupling structures 16, 17 of the mouth or opening 15 of the bag-type container 10.

The slider 18 includes a body section 19 and a pair of side legs 20, 21 that are configured to extend downward over the outer top edges of the mouth or opening 15 of the bag-type container 10 and engage the outer or side portions of the cooperating coupling structures 16, 17 so that the slider 18 slides along the top of the bag-type container 10 while inner surfaces of the legs 20, 21 engage the cooperating coupling structures 16, 17 and prevent the slider 18 from being pull off the top of the bag-type container 10.

Figure 3:
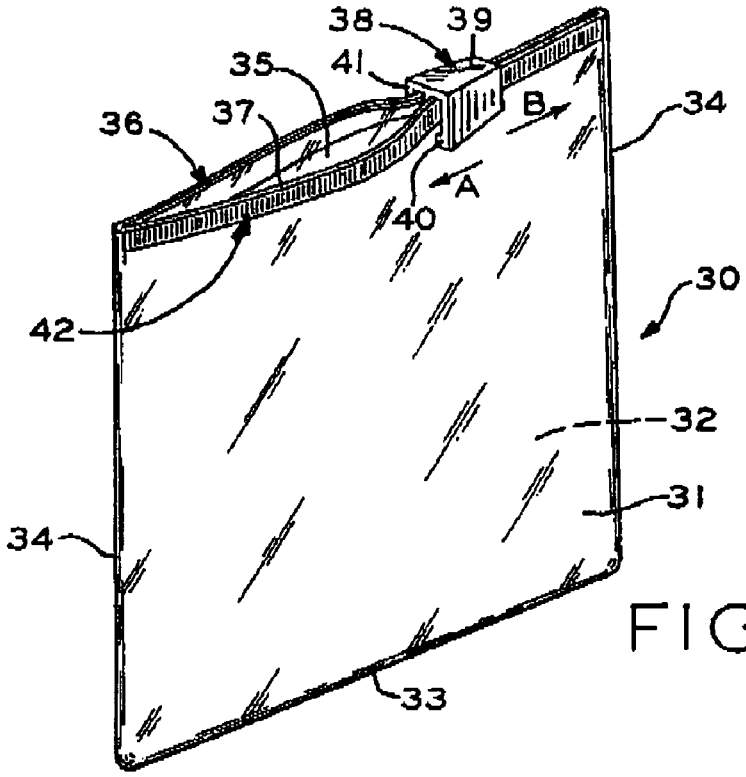
FIG. 3 is a perspective view of a bag-type container according to one embodiment of the present invention that is provided with a one-way zipper-locking closure.

FIG. 3 is a perspective view of a bag-type container according to one embodiment of the present invention that is provided with a one-way zipper-locking closure. In their simplest forms, the one-way zipper-locking closures of the present invention can be thought of as incorporating the features of a wire harness into a bag-type container that is provided with a closure mechanism having a slider. Specifically, the serrated element of a wire harness is provided along one or both opposite outer side edges of the mouth or opening of a bag-type closure, and the tang element (or two or more tang elements) of a wire harness are provided in the slider. With this combination, as the slider is slide across the mouth or opening of the bag-type container, the tang(s) within the slider engages the serrated portion(s) on the outer side edge(s) of the mouth or opening of a bag-type closure so that, as the slider is slide along the direction that causes the bag-type container to become closed, the slider cannot be moved in the opposite direction. Accordingly, once the bag-type container if closed, it cannot be opened by manipulating the slider.

The bag-type container 30 in FIG. 3 is formed from side panel members 31, 32 that are sealed together or integral along the bottom 33 and sides 34. A mouth or opening 35 provided along a top side of the bag-type container 30 is defined by opposed top side edges of the side panel members 31, 32. The opposite top side edges of the bag-type container 30 are provided with cooperating coupling structures 36, 37 that can couple together or interlocked in a known manner. Such cooperating coupling structures 36, 37 are exemplified by elongate beading elements that have cross sectional profiles or shapes that allow the opposed beading elements on opposite sides of the mouth or opening 35 to engage and couple together or interlock. According to the present invention, the cooperating coupling structures 36, 37 are preferably configured so that once coupled together, they cannot be easily pulled apart or uncoupled. In the bag-type container 30 of FIG. 3, the cooperating coupling structures 36, 37 (opposed beading elements) are configured so that when the slider 38 is slid in the direction indicated by arrow "A," the slider 38 couples the cooperating coupling structures 36, 37 of the mouth or opening 35 of the bag-type container 30 together. The slider 38 could be configured so that if it were possible to slide the slider 38 in the opposite direction indicated by arrow "B," the slider 38 would uncouple the cooperating coupling structures 36, 37 of the mouth or opening 35 of the bag-type container 30. That is, although provisions do not have to be made for the slider 38 to uncouple the cooperating coupling structures 36, 37, the present invention could be realized by including the series of registration structures and catch mechanism(s) in a conventional bag-type container provided with a slider that allow the mouth or opening of the container to be opened or closed by operation of the slider.

The slider 38 includes a body section 39 and a pair of side legs 40, 41 that are configured to extend downward over the outer top edges of the mouth or opening 35 of the bag-type container 30 and engage the outer or side portions of the cooperating coupling structures 36, 37 so that the slider 38 slides along the top of the bag-type container 30 while inner surfaces of the legs 40, 41 engage the cooperating coupling structures 36, 37 and prevent the slider 38 from being pull off the top of the bag-type container 30.

A series of registration structures 42 are shown as being provided on an outer side of the mouth or opening 35 of the bag-type container 30. This series of registration structures 42 can comprise teeth-shaped structures similar to the serrated portion 3 of the wire harness 1 depicted in FIG. 1. Alternatively, the series of registration structures 42 can comprise projections and/or depressions with any convenient shape, including for example, rectangular, circular, etc. In addition, the series of registration structures 42 can be provided on one or both of the outer sides of the mouth or opening 35 of the bag-type container 30. Alternatively, or in addition, the series of registration structures 42 can be provided along the top edges(s) of the mouth or opening 35 of the bag-type container 30.

In order to perform the one-way zip-locking function, the slider 38 in FIG. 3 is provided with a catch mechanism 50 (see FIG. 4) that is configured to engage the registration structures 42. The catch mechanism 50 can comprise an internal tang similar to that used in the wire harness 1 of FIG. 1.

Figure 4:
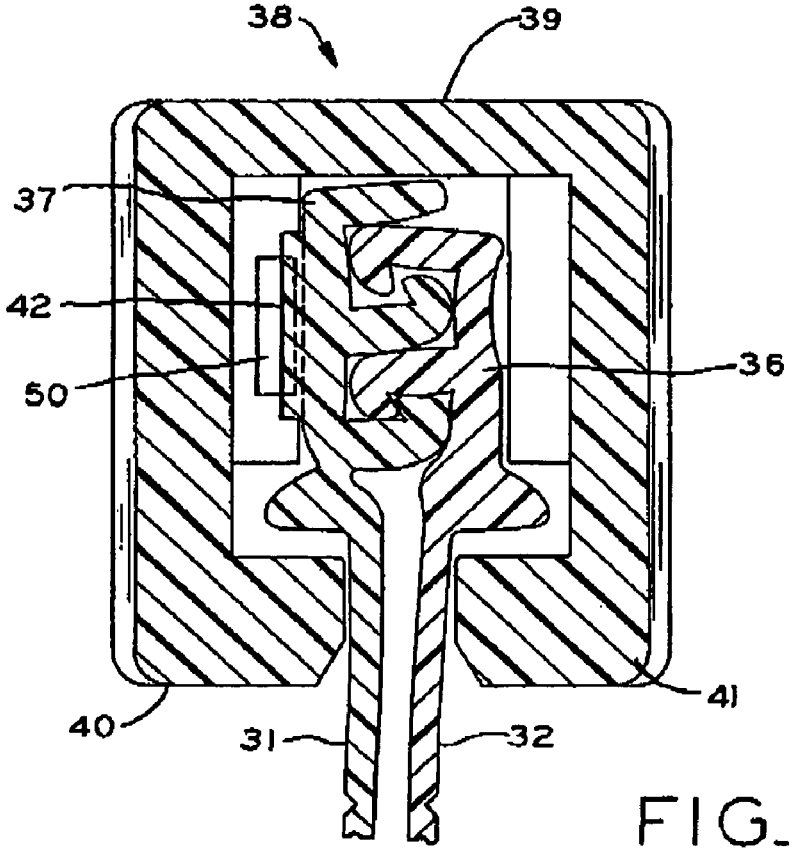
FIG. 4 is a cross sectional view of a locking slider according to one embodiment of the present invention.
Figure 5:
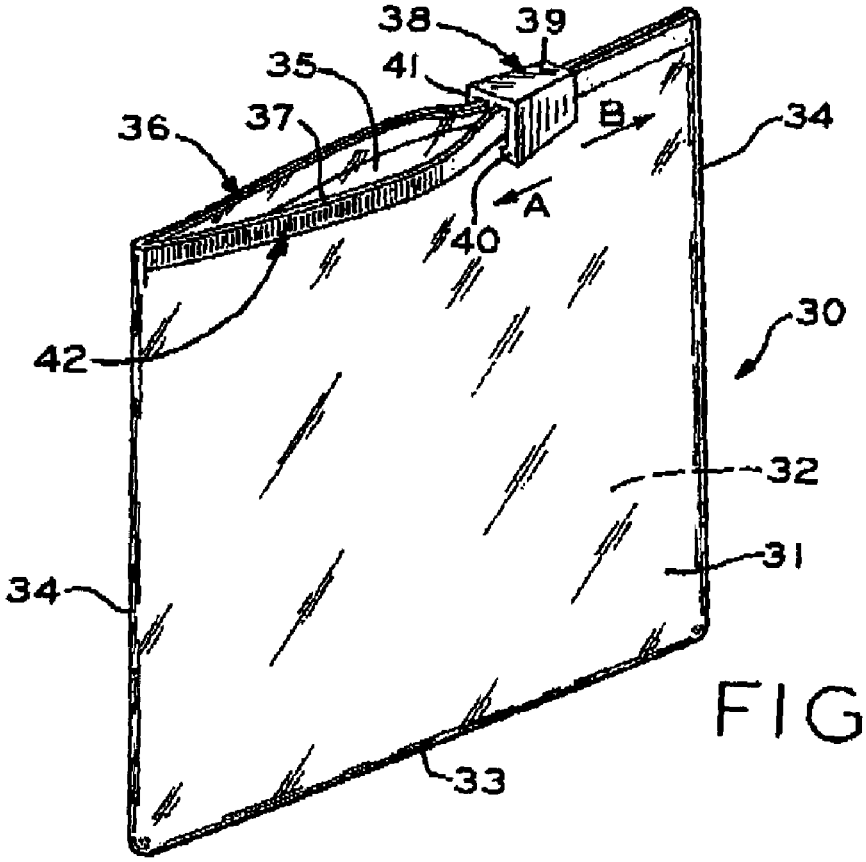
FIG. 5 is perspective of a bag-type container according to an alternative embodiment of the present invention that is provided with a series of projecting structures extending at least along a middle portion.

FIG. 4 is a cross sectional view of a locking slider according to one embodiment of the present invention. The slider 38 in FIG. 4 is depicted as having engaged cooperating coupling structures 36, 37 together in a known manner. In FIG. 4 the outer side of one of the cooperating coupling structure 37 is depicted as including a series of registration structures 42 thereon. The series of registration structures 42 and be affixed to or integral with the cooperating coupling structure 37. A catch mechanism 50 in the form or a biased tang is provided on an inner surface of the slider 38 adjacent the outer side of the cooperating coupling structure 37 having the series of registration structures 42. The catch mechanism 50 engages the registration structures 42 in a manner similar to the functioning of the wire harness 1 discussed above, to allow the slider 38 to be slide only in the direction that causes the bag-type container 30 to be closed. Therefore, the one-way zip-locking closure mechanism of the present invention allows a bag-type container to be closed and, once closed, prevents the bag-type container from being opened.

The catch mechanism 50 can comprise a biased structure, e.g. metal tang that deflects against the registration structures 42 in one direction and engages the registration structures 42 in an opposite direction. Such structures are found in wire harnesses. The catch mechanism 50 can be angled with respect to the registration structures 42 so as to be deflected thereby in one direction and become engaged in an opposite direction. Otherwise, the shape of the registration structures 42 can be configured to slide over and deflect the catch mechanism 50 in one direction and engage the catch mechanism in an opposite direction. For example, the registration structures can have tapered, sloped or other cam shapes that are configured to slide over and deflect the catch mechanism 50 in one direction and engage the catch mechanism in an opposite direction. The catch mechanism can therefore be biased with or without the use of a supplemental means such as a separate spring element.

In order to simplify the description, FIG. 4 depicts an embodiment of the invention in which the series of registration structures 42 are provided on one of the outer sides of the mouth or opening 35 of the bag-type container 30 (actually on the outer side of the cooperating coupling structure 37). As discussed above, the series of registration structures 42 can be provided on one or both of the outer sides of the mouth or opening 35 of the bag-type container 30 or, alternatively or in addition, along the top edges(s) of the mouth or opening 35 of the bag-type container 30. In such alternative embodiments, appropriated catch mechanisms 50 can be provided in inner surfaces of the slider 50 adjacent the registration structures for purposes of engaging the registration structures 42. It is also to be understood that the catch mechanisms 50 can be complementarily configured to engage the registration structures 42.

Once the bag-type containers of the present invention are closed, they can be cut open to gain access to the contents thereof. Otherwise, the bag-type containers of the present invention can be provided with rupturable, frangible, tearable, breachable, or similar structures or portions by which access to the contents thereof can be gained without the need of scissors, knifes, or other auxiliary tools. For example, a portion or area of the bag-type containers can be perforated or otherwise weakened or provided with non-resealable structures to gain access to the contents therein if desired.

Bag-type containers having the one-way zip-locking closures of the present invention can provide solutions to a number of problems. For example, bag-type containers of the present invention can be used to collect evidence at crime scenes and thereby limit the possibility that such collected evidence can be tampered with after the one-way zip-locking closures are closed. In hospitals and medical clinics, body fluid samples are often enclosed in small resealable plastic bags when they are transported. Providing such small resealable plastic bags with the one-way zip-locking closures of the present invention will increase the safety of handling and transporting such samples. Bag-type containers having the one-way zip-locking closures of the present invention can be used to pack school lunches and thereby ensure that such lunches will not be tampered with. Bag-type containers provided with the one-way zip-locking closures of the present invention can be used to courier documents while providing a means of determining if the documents have been accessed by unauthorized persons. These are only a very limited list of uses of the one-way zip-closing closures of the present invention. The bag-type containers could be made from plastic materials, foils, woven materials, laminates, and other flexible materials.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of claims which are attached below.

What is claimed is:

1. A bag-type container having a mouth defined by opposed side panels, said bag-type container comprising:

cooperating coupling structures provided along upper portions of the opposed side panels adjacent the mouth, said cooperating coupling structures each having substantially planar outward facing side wall portions;

a slider coupled to the cooperating coupling structures for closing the mouth of the bag-type container when slid in a first direction between a first position to a second position; and a series of projecting structures formed separately from and attached to at least one of said substantially planar outward facing side wall portions of at least one of said cooperating coupling structures, said series of projecting structures extending at least along a middle portion of the bag-type container, wherein the slider is provided with a structure that abuts the series of projecting structures.

2. A bag-type container according to claim 1, wherein a series of projecting structures is formed separately from and attached to the substantially planar outward facing side wall portions of each of the cooperating coupling structures.

3. A bag-type container according to claim 2, wherein the projecting structures are substantially parallel to one another and to side edges of the bag-type container.

4. A bag-type container according to claim 2, wherein a series of the projecting structures is spaced apart from a top edge of a respective one of each of the cooperating structures.

5. A bag-type container according to claim 1, wherein the projecting structures are substantially parallel to one another and to side edges of the bag-type container.

6. A bag-type container according to claim 1, wherein the series of projecting structures extends across the entire width of the bag-type container.

7. A bag-type container according to claim 1, wherein the slider extends over the series of projecting structures.

8. A bag-type container according to claim 1, wherein the series of projecting structures is spaced apart from a top edge of the at least one of said cooperating structures.

* * * * *